United States Patent [19]

Perkins, Jr. et al.

[11] 4,253,075

[45] Feb. 24, 1981

[54] LATCHING SYSTEM FOR CONTACT OPERATING MECHANISM

[75] Inventors: Norman P. Perkins, Jr., Westminster; G. Erich Heberlein, Jr., Sykesville, both of Md.

[73] Assignee: Gould Inc., Rolling Meadows, Ill.

[21] Appl. No.: 3,133

[22] Filed: Jan. 15, 1979

[51] Int. Cl.[3] ..... H01H 77/00

[52] U.S. Cl. ..... 335/24; 335/174

[58] Field of Search ..... 335/24, 21, 22, 23, 335/35, 6, 170, 174

[56] References Cited

U.S. PATENT DOCUMENTS

| | | | |
|---|---|---|---|
| 3,525,959 | 8/1970 | Ellsworth et al. | 335/24 |
| 4,088,973 | 5/1978 | Kussy et al. | 335/6 |

*Primary Examiner*—Harold Broome
*Attorney, Agent, or Firm*—Harold Huberfeld

[57] ABSTRACT

A trip-free contact operating mechanism is provided with a latching system for maintaining a releasable cradle in its reset position. The latching system includes a lever mounted on a fixed pivot and having one end latchable by a cam member movable by a fault current responsive automatic trip means. A latch pin mounted in slots at the other end of the lever is engageable with the cradle for maintaining the latter in reset position. The latch pin is movable mounted on the lever in a manner such that the former may rotate about its axis, it may move lengthwise of the mounting slots, and the pin may pivot about an axis perpendicular to the pin axis and in the vicinity of one end of the pin.

10 Claims, 7 Drawing Figures

LATCHING SYSTEM FOR CONTACT OPERATING MECHANISM

This invention relates generally to trip-free contact operating mechanisms and more particularly relates to an improvement of the contact operating mechanism described in U.S. Pat. No. 4,088,973 issued May 9, 1978 to F. W. Kussy et al for a Unitized Combination Starter.

As circuit breaker constructions become more compact, less space is available for relative movement between elements of the contact operating mechanism and latching system thereof. This appears to be particularly serious when relatively high energy main springs are required for contact operation. Under such circumstances a plurality of latching points are usually interposed between the releasable cradle of the operating mechanism and the fault responsive means provided to release the latching system which maintains the cradle in latched position.

Pursuant to the instant invention, an improved latching system is constructed by utilizing a lever mounted on a fixed pivot located intermediate the ends of the lever. One end of the lever is latchable by a latch cam. At the other end of the latch lever there are parallel slots through which a latch pin extends, with one slot being substantially longer than the other slot. A single torsion spring biases the lever, the trip cam and the latch pin toward their reset positions. In particular, the latch pin in moving between its latching and released positions is free to roll on its outer surface, to move along the slot axis, and to pivot about an axis which is perpendicular to the pin axis and located near one end of the pin.

Accordingly, a primary object of the instant invention is to provide an improved latching system for a trip-free contact operating mechanism.

Another object is to provide a latching system of this type which eliminates problems relative to variable tripping.

Still another object is to provide a latching system of this type which is of an economic construction in that secondary grinding operations are not required.

Yet another object is to provide a latching system of this type which includes a latch pin mounting having reduced friction so as to permit a more positive resetting action.

A further object is to provide a latching system of this type having a lever mounted on a fixed pivot and having a pin movably mounted on the lever and directly engageable with the releasable cradle of the contact operating mechanism.

A still further object is to provide a latching system of this type including a lever which mounts a latch pin in such a manner that the latter may roll about its axis, may slide in guide slots through which the pin extends and may pivot about an axis perpendicular to the pin axis and disposed near one end thereof.

These objects as well as other objects of this invention shall become readily apparent after reading the following description of the accompanying drawings in which.

Figure 1:
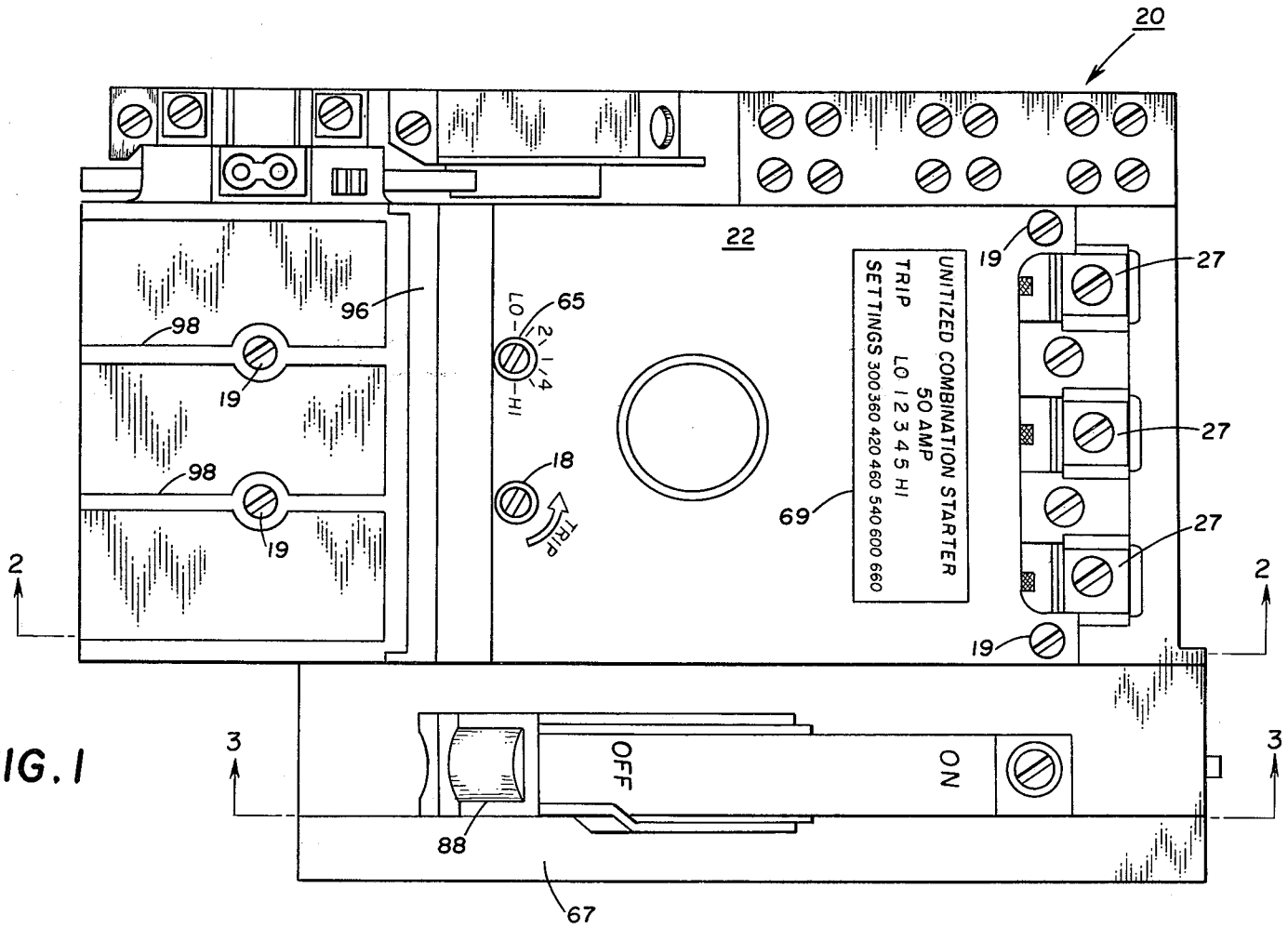
FIG. 1 is a plan view of a unitized combination motor starter including a trip-free contact operating mechanism having a latch system constructed in accordance with teachings of the instant invention.

Now referring to the Figures. Unitized Combination motor starter 20 includes a molded insulating housing consisting of base 21 and removable shallow front cover 22 secured in operative position by screws 19. In a manner well known to the art, cover 22 includes internal longitudinally extending parallel ribs that mate with similar ribs in base 21 to form elongated parallel compartments. Three of these compartments have current carrying elements identical to those illustrated in the right hand portion of FIG. 2, and constitute a pole of the three pole circuit breaker portion 59 of starter 20. Removable side cover 67 is provided for the compartment which contains spring powered trip free contact operating mechanism 70 of FIG. 3.

Figure 2:
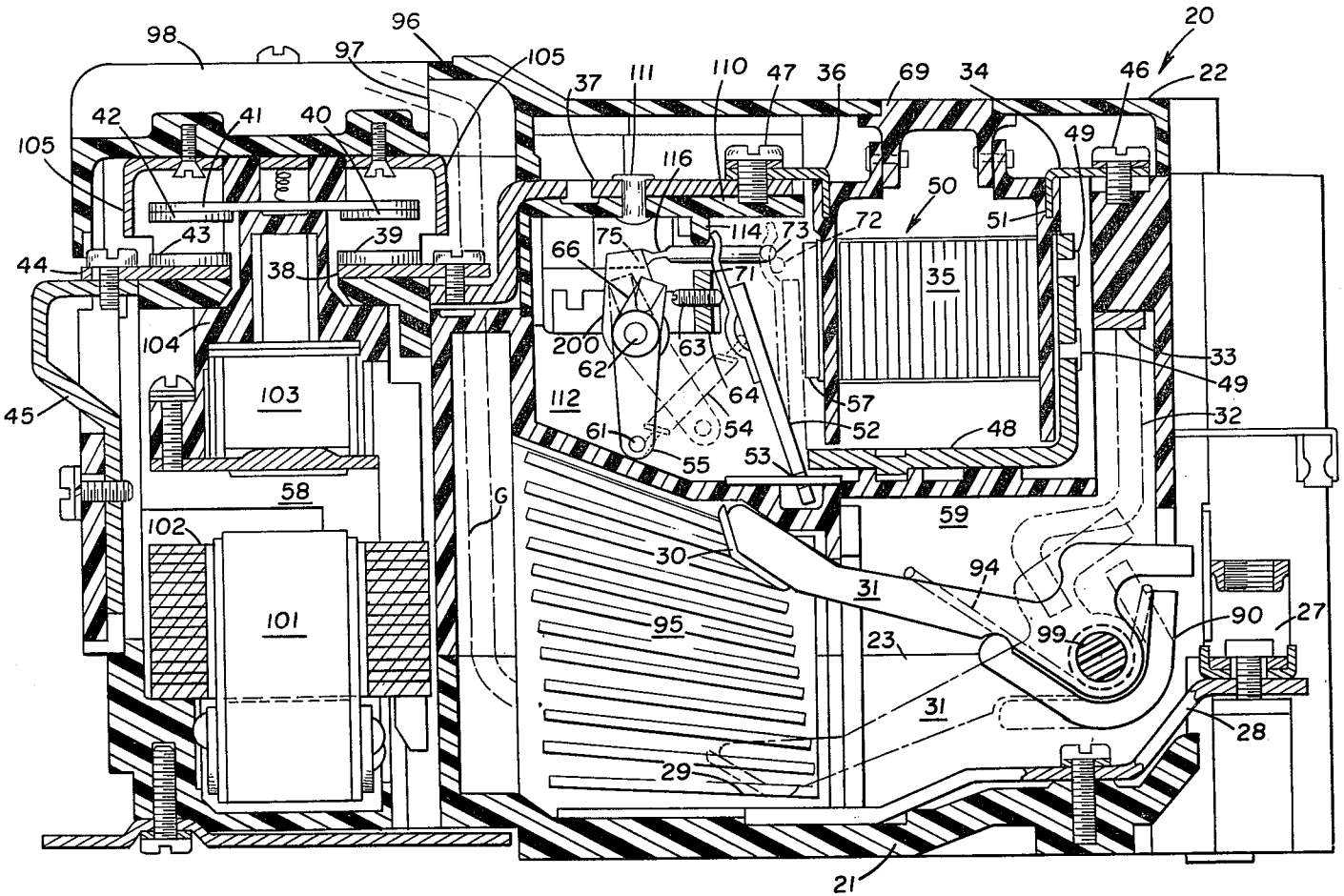
FIG. 2 is a cross-section taken through line 2—2 of FIG. 1 looking in the direction of arrows 2—2 and showing the elements of one pole unit of the starter.

The current carrying path for each of the three poles of starter 20 is identical so that only one of these paths shall be described with particular reference to FIG. 2. This current path includes wire grip 27 at one end of line terminal strap 28, strap 28, stationary contact 29 at the other end of strap 28, movable contact 30 at one end of movable contact arm 31, arm 31, flexible braid 32 at the other end of arm 31, U-shaped strap 33, coil terminal 34, coil 35, the other terminal 36 for coil 35, conducting straps 37 and 38, stationary contact 39 of electromagnetic contactor portion 58 of starter 20, movable contactor contact 40, conducting bridge 41, movable contactor contact 42, stationary contactor contact 43, conducting strap 44, and load terminal strap 45. The latter is constructed so as to be connectible directly to a load or to be connectible to a load through a conventional overload relay (not shown).

Coil 35 is part of circuit breaker calibrating assembly 50 removable and replaceable from the front of starter 20 after front cover 21 is removed. The calibrating assemblies 50 of all three poles may be individual units or they may be connected to a common insulating member 69 (FIG. 1) so that all three assemblies 50 must be removed as a unit.

Each subassembly 50 is electrically and mechanically secured in operative position by a pair of screws 46, 47 that are accessible when cover 22 is removed from base 21. Coil 35 is wound about bobbin 57 that surrounds one leg of stationary C-shaped magnetic frame 48. The latter is secured by rivets 49, 49 to insulator 51 having terminal 34 and bobbin 57 mounted thereto. The magnetic frame also included movable armature 52 which is pivotally mounted at its lower end in the region indicated by reference numeral 53 so that the upper end of armature 52 may move toward and away from stationary frame portion 48. Coiled tension spring 54 is connected to pin formation 61 at the edge of adjusting bar 55 remote from its pivot provided by pins 62. Thus, spring 54 biases the forward end of armature 52 away from magnetic frame 48.

The air gap adjustment between armature 52 and frame 48 is set by screw 63 which is threadably mounted to transverse member 64. A cam (not shown) at the rear of pivotable adjusting control 65 engages extension 66 of member 55 to adjust the tension on all three springs 54 without changing the air gaps between any of the armatures 52 and their associated stationary frame sections 48. Control 65 extends through and is journalled for movement within a circular aperture (not shown) of auxiliary cover 110. Turn-to-trip control 18 extends through and is journalled for movement within another circular aperture of auxiliary cover 110. Both controls 65 and 18 are accessible for operation through apertures in main cover 22.

Upon the occurrence of predetermined fault current conditions the flux generated by current flowing in coil 35 attracts armature 52 to stationary frame 48 causing bifurcated armature bracket 71 to engage enlarged formation 72 on transverse extension 73 of common tripper bar 75. The latter is part of tripper bar means 200 that pivots clockwise about an axis which coincides with axis 62 for adjusting bar 55. This causes screw 76 (FIG. 3) on tripper bar extension 77 to engage projection 78*a* at one end of latch cam 78 and pivot latch cam member 78 in a clockwise or tripping direction about its pivot 79, thereby releasing the latching system of contact operating mechanism 500.

More particularly, latch cam 78 also includes latching tip 78*b* at the end of cam 78 remote from projection 78*a*. Tip 78*b* extends into window 502 in web portion 503 of latch lever 505. The latter is a generally U-shaped member mounted on stationary pivot 504. At the end of lever 505 on the side of pivot 504 opposite web 503, lever 505 is provided with spaced parallel arms or walls 506, 507 in planes perpendicular to pivot 504. Latch pin 510 is supported by walls 505, 507 extending through slot-like apertures 508, 509 in the respective walls 506, 507. Apertures 508, 509 are elongated and parallel with aperture 508 being much longer than aperture 509. Inboard of wall 507, pin 510 is provided with annular shoulder 511 having beveled edge 512 lying adjacent wall 507. The central portion of torsion spring 525 is wound around pivot pin 504 with one end 526 of spring 525 extending through an aperture of cam member ear 78*c* to bias cam member 78 counterclockwise with respect to FIG. 3. The other end 527 of spring 525 is disposed adjacent the inboard surface of wall 506 and bears against latch pin 510 to bias the latter toward its latching position at the right end of slot 508. The force of spring 525 is also transmitted through pin 510 to bias latch lever 505 clockwise, or toward its latching position. However the force exerted on lever 505 by main operating springs 86, 88 acting through cradle 80 opposes and far exceeds the force exerted by spring 525 on lever 505.

Figure 3:
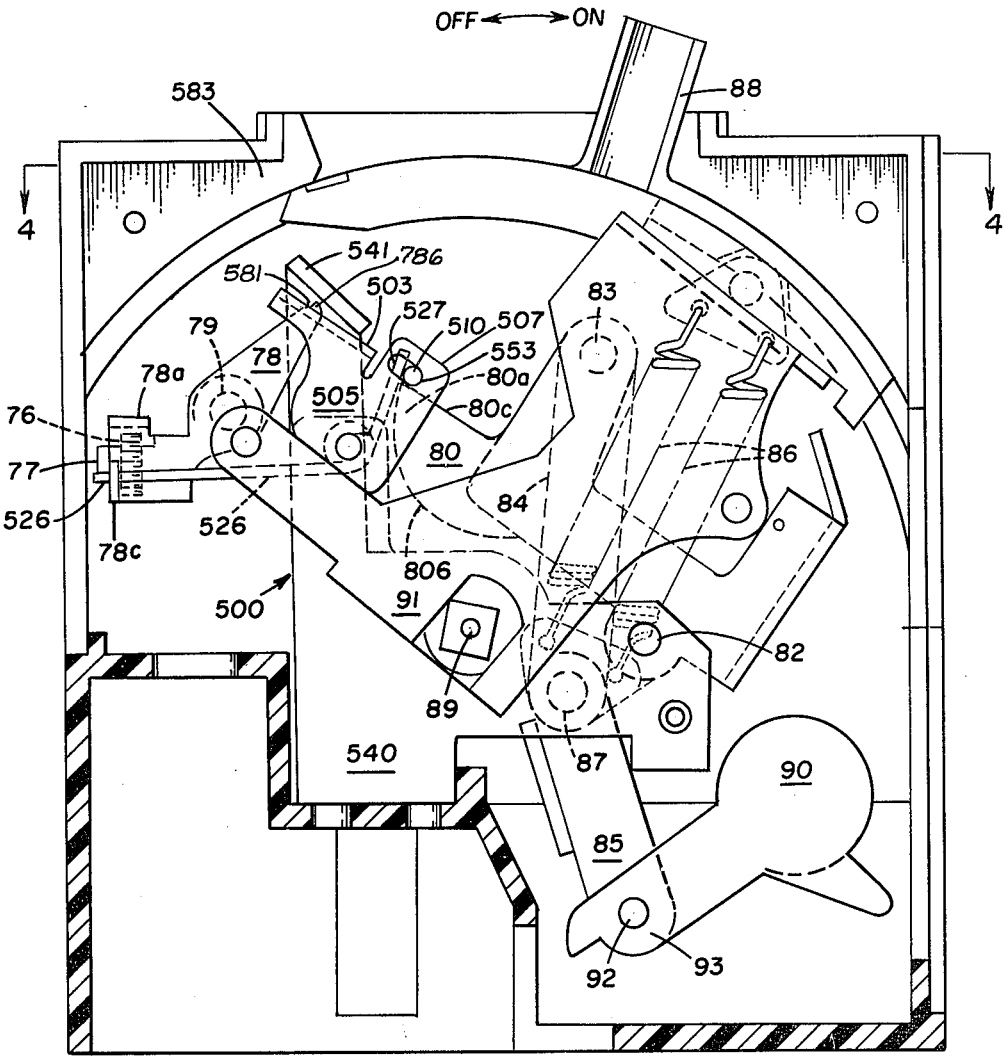
FIG. 3 is a cross-section taken through line 3—3 of FIG. 1 looking in the direction of arrows 3—3 and showing the elements of the contact operating mechanism in contact closed position.
Figure 4:
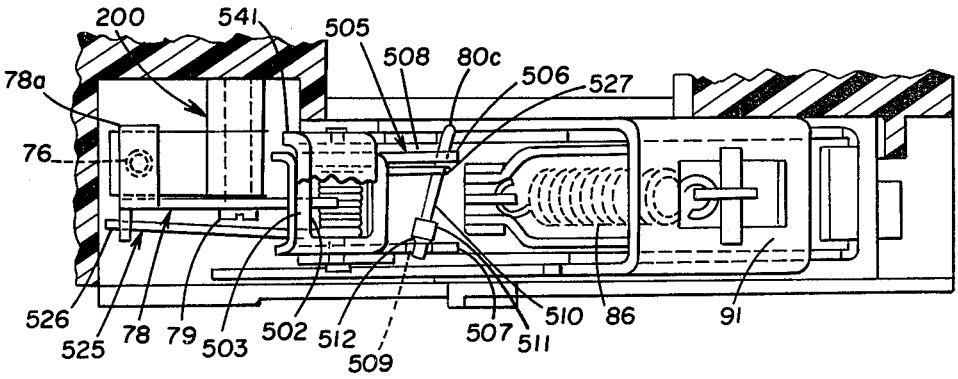
FIG. 4 is a plan view of the operating elements of FIG. 3 looking in the direction of arrows 4—4 of FIG. 3, with the manually engageable portion of the operating means removed for the sake of clarity.

When screw 76 engages projection 78*a* of latch cam 78 to pivot the latter clockwise from its position of FIG. 3, latching point 581, where cam 78 engages lever 505, is released. Now lever 505 is free to pivot counterclockwise to release latching point 553, where latch pin 510 engages latching tip 80*a* of cradle 80, so that the latter is free to pivot clockwise about pivot 82. As cradle 80 pivots clockwise, end 83 of upper toggle link 84 moves up and to the right with respect to FIG. 3 permitting coiled tension main springs 86, connected between toggle knee 87 and manual operating handle 88 to collapse toggle 84, 85 and move handle 88 to the left. The latter is pivoted about center 89 through a connection between handle 88 and its rearward extension 91.

The lower end of toggle link 85 is pivotally connected at 92 to the free end of radial extension 93 of contact carrier 90. Thus, as toggle 84, 85 collapses carrier 90 is pivoted clockwise with respect to FIG. 3 and by so doing moves the contact arms 31 of all three poles to the solid line or open circuit position of FIG. 2.

Figure 5:
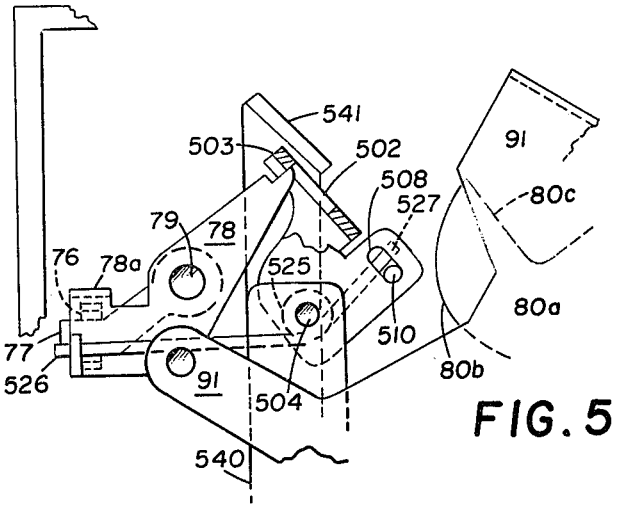
FIGS. 5 and 6 show a fragmentary portion of the mechanism of FIG. 4, with the latching system shown in the tripped position in FIG. 5 and being reset in FIG. 6.
Figure 6:
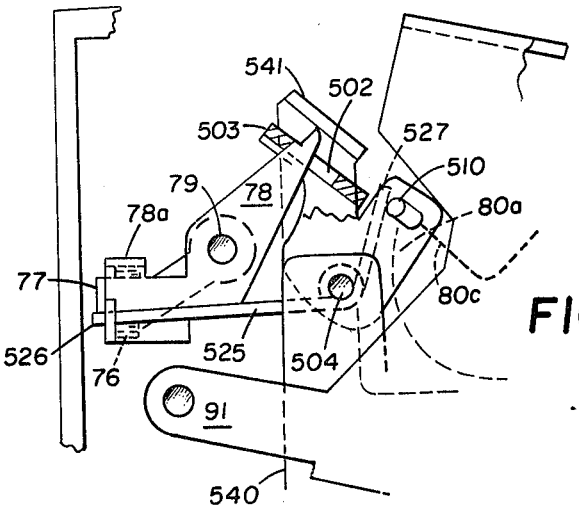
Figure 7:
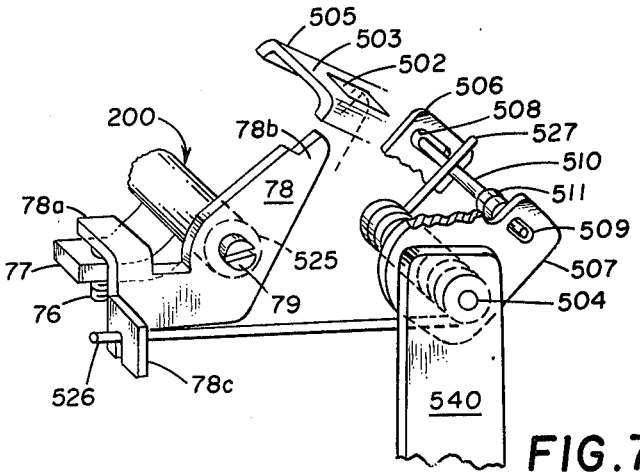
FIG. 7 is an exploded perspective of key elements in FIG. 3.

In order to move the latching system from its tripped position of FIG. 5 to its reset position of FIG. 3, operating handle 88 is pivoted counterclockwise causing cradle 80 to pivot counterclockwise with latching tip 80*a* thereof moving downward. As this occurs curved edge 80*b* of tip 80*a* engages latch pin 510 and forcing it toward the left end of the longer slot 508 until latch tip surface 80*c* moves below pin 510 at which time the latter is driven by spring 525 to its latching position above surface 80*c*. During this time lever 505 pivots clockwise under the influence of spring 525 until lever ear 503 engages ear 541 of stationary frame 540 by mechanism 500. This permits spring 525 to pivot cam 78 counterclockwise for engaging and latching lever 505. Subsequent release of handle 88 permits the force exerted by main springs 86 to move latch tip 80*a* upward, and transmitting a force through pin 510 to pivot lever 505 counterclockwise into latching engagement with cam 78 at notched tip 78*b* thereof. Now latching points 581 and 553 are set and the latching system is reset.

It is noted that the relatively loose slot-type mounting for latch pin 510 permits the latter to turn rotationally and also to translate along the axis of slots 508, 509. In addition the mounting of pin 310 permits pivoting thereof about an axis in the region of wall 507 with this pivoting motion being facilitated by beveled edge 512. All in all the movement of pin 310 during resetting is essentially friction-less resulting in positive resetting action under the influence of spring 525.

It is noted that base 21 is a multipart unit having sections which mate along dividing line 23 so that reduced diameter bearing portions of contact carrier 90 may be inserted and capture in operative positions. In the closed position of circuit breaker portion 59 an individual torsion spring 94, wound around rod 99 and interposed between carrier 90 and movable contact arm 31, biases arm 31 counterclockwise about insulating rod 99 as a center and thereby generates contact pressure.

For each pole of the three circuit breaker poles, an individual parallel plate arc chute 95 is provided to facilitate extinction of arcs drawn between circuit breaker contacts 29, 30 upon separation thereof. Arcing gases exiting from arc chute 95 at the left thereof with respect to FIG. 2 migrate forward as indicated by the dash lines G and are directed by hooded portion 96 of cover 22 to exit through opening 97 and flow to the left with respect to FIG. 2 in front of contactor section 58. External cover barriers 98 serve to prevent direct mixing of arcing gases from different poles at the instant these gases leave housing 21, 22 through exit openings 97.

The electrical and magnetic elements of contactor 58 are generally of conventional construction and include U-shaped magnetic yoke 101 whose arms are surrounded by portions of coil 102. When the latter is energized, armature 103 is attracted to yoke 101 and carries contact carrier 104 rearward. The latter mounts the bridging contacts 41 of all three poles so that contacts 41 move to their closed position wherein movable contacts 40, 42 engage the respective stationary contacts 39, 43. Steel elements 105 mounted to the inside of cover 22 are positioned in the regions of the contactor contacts 39, 40, 42, 43 whereby extinction of arcs drawn between these contacts upon separation thereof is facilitated through magnetic action.

Rivet 111 (FIG. 2) secures conducting strap 37 on the forward surface of insulating cover 110 of L-shaped cross-section. The latter forms the forward boundary for chamber 112 wherein common tripper bar 75, adjusting bar 55 and armatures 52 are disposed. After the removal of main cover 22, auxiliary cover 110 is removable for access to adjusting screws 63. The rear surface of cover 110 is provided with protrusions 114 which engage and guide movement of extensions 73. The latter are flexibly mounted to trip bar 75 at resilient reduced cross-section areas 116 which are constructed to bias extensions 73 forward.

For more detailed descriptions of certain elements illustrated in the drawings reference is made to one or more of the following U.S. Pat. Nos. 4,088,973 issued May 9, 1978, 4,066,989 issued Jan. 3, 1978, 4,087,769 issued May 2, 1978 and 4,095,075 issued June 13, 1978.

Although a preferred embodiment of this invention has been described, many variations and modifications will now be apparent to those skilled in the art, and it is therefore preferred that the instant invention be limited not by the specific disclosure herein but only by the appending claims.

What is claimed is:

1. An electrical switch device including a set of cooperating contacts and trip-free contact mechanism operatively connected to said contacts for opening and closing the latter; said mechanism including a cradle mounted for movement between a reset and a tripped position, main spring means biasing said cradle toward said tripped position, manual operating means operatively mounted for movement between open and closed positions; with said cradle in said reset position said manual operating means in moving between said open and closed positions being effective to operatively position said spring means relative to contacts to, respectively, open and close said contacts by energy stored in said spring means, with said cradle in said tripped position movement of said manual operating means being ineffective to close said contacts; said mechanism also including a releaseable latching system for maintaining said cradle in said reset position; said latching system including a latch pin engageable with a latching tip of said cradle to hold said cradle in said reset position; first means mounting said pin for movement transverse to the length thereof between a cradle holding and a cradle releasing position; first biasing means urging said pin to said holding position; said first means including first and second apertures spaced along the length of said pin and wherein said pin is rotatably supported; said first aperture being elongated; said first biasing means urging said pin toward one end of said first aperture; and said second aperture being substantially shorter than the first aperture whereby said pin in moving toward the other end of said first aperture pivots about an axis in the vicinity of said second aperture and transverse to the length of said pin.

2. An electrical switch as set forth in claim 1 in which the pin is provided with a beveled annular shoulder in the vicinity of said second aperture.

3. An electrical switch as set forth in claim 1 in which the latching system also includes a lever having spaced first and second walls with said first and second apertures, respectively, formed therein; said latching tip engaging said latching pin at a portion thereof outboard of said first wall.

4. An electrical switch as set forth in claim 1 in which the latching system also includes a lever having spaced first and second walls with said first and second apertures, respectively, formed therein; a pivot for said lever extending transverse to said walls; a latch member for releaseably holding said lever in a latching position wherein said latch pin may hold said cradle in its said reset position; said latch member being operable to a tripping position to release said lever thereby permitting said main spring means acting through said cradle and said latch pin to move said lever to a position wherein said latch pin is ineffective to hold said cradle in its said reset position.

5. An electrical switch as set forth in claim 4 also including a second biasing means urging the latch member toward a position for holding said lever in its said latching position; and a third biasing means urging said lever toward said position wherein said latch pin is ineffective to hold said cradle in its said reset position; at said lever said main spring means acting against said third biasing means.

6. An electrical switch as set forth in claim 5 in which a single spring constitutes said first, second and third biasing means.

7. An electrical switch as set forth in claim 6 in which the single spring is a torsion wound around said pivot for said lever; said single spring having its opposite ends bearing against said latch member and said latch pin.

8. An electrical switch as set forth in claim 7 in which said pivot for said lever defines a fixed axis for said lever.

9. An electrical switch device including a set of cooperating contacts and trip-free contact mechanism operatively connected to said contacts for opening and closing the latter; said mechanism including a cradle mounted for movement between a reset and a tripped position, main spring means biasing said cradle toward said tripped position, manual operating means operatively mounted for movement between open and closed positions; with said cradle in said reset position said manual operating means in moving between said open and closed positions being effective to operatively position said spring means relative to contacts to, respectively, open and close said contacts by energy stored in said spring means, with said cradle in said tripped position movement of said manual operating means being ineffective to close said contacts; said mechanism also including a releaseable latching system for maintaining said cradle in said reset position; said latching system including a latch pin engageable with a latching tip of said cradle to hold said cradle in said reset position; first means mounting said pin for movement transverse to the length thereof between a cradle holding and a cradle releasing position; first biasing means urging said pin to said holding position; said first means including first and second apertures spaced along the length of said pin and wherein said pin is rotatably supported; said first aperture being elongated; said first biasing means urging said pin toward one end of said first aperture; and a lever having spaced first and second walls with said first and second apertures, respectively, formed therein; said pin when in said holding position being inclined with respect to both of said walls.

10. An electrical switch as set forth in claim 9 in which the second aperture is substantially shorter than the first aperture whereby said pin in moving toward the other end of said first aperture pivots about an axis in the vicinity of said second aperture and transverse to the length of said pin; said latching tip engaging said pin at a portion thereof outboard of said first wall; said first biasing means engaging said pin at a portion thereof adjacent the inboard surface of said first wall.

* * * * *